US009993087B1

(12) United States Patent
Ricks et al.

(10) Patent No.: US 9,993,087 B1
(45) Date of Patent: Jun. 12, 2018

(54) COLLAPSIBLE TRIPOD FISHING SEAT

(71) Applicants: Richard Ricks, China Grove, TX (US); Alexandra Ricks, China Grove, TX (US)

(72) Inventors: Richard Ricks, China Grove, TX (US); Alexandra Ricks, China Grove, TX (US)

( * ) Notice: Subject to any disclaimer, the term of this patent is extended or adjusted under 35 U.S.C. 154(b) by 73 days.

(21) Appl. No.: 15/225,967

(22) Filed: Aug. 2, 2016

(51) Int. Cl.

| | |
|---|---|
| ***A47C 3/20*** | (2006.01) |
| ***A47C 3/34*** | (2006.01) |
| ***A47C 4/28*** | (2006.01) |
| ***A47C 9/10*** | (2006.01) |
| ***A47C 4/04*** | (2006.01) |

(52) U.S. Cl.
CPC ..... *A47C 9/105* (2013.01); *A47C 3/20* (2013.01); *A47C 3/34* (2013.01); *A47C 4/04* (2013.01); *A47C 4/28* (2013.01); *A47C 9/10* (2013.01)

(58) Field of Classification Search
CPC .... A47C 3/20; A47C 3/34; A47C 3/40; A47C 4/28; A47C 4/52; A47C 9/10; A47C 9/105
See application file for complete search history.

(56) References Cited

U.S. PATENT DOCUMENTS

| | | | | |
|---|---|---|---|---|
| 4,232,896 | A | 11/1980 | Caldwell | |
| 4,562,983 | A * | 1/1986 | Klefbeck | B65B 67/12 248/97 |
| 4,934,638 | A * | 6/1990 | Davis | A47C 4/286 108/118 |
| 5,522,642 | A * | 6/1996 | Herzog | A47C 3/38 248/188.2 |
| 5,673,966 | A | 10/1997 | Morton, Jr. | |
| 5,851,052 | A * | 12/1998 | Gustafsson | A47C 4/286 248/164 |
| 6,203,103 | B1 | 3/2001 | Presson | |
| 6,467,843 | B1 * | 10/2002 | Rossborough | A47C 3/34 108/150 |
| D566,409 | S | 4/2008 | Lindqvist | |
| 7,367,617 | B1 * | 5/2008 | Bond | A47C 4/286 248/431 |
| 8,465,090 | B1 | 6/2013 | O'Connor | |
| 9,010,010 | B2 * | 4/2015 | Dreiband | F41A 35/00 42/106 |
| 2003/0042075 | A1 | 3/2003 | Bench | |
| 2004/0140696 | A1 * | 7/2004 | Grace | A47C 9/105 297/16.2 |
| 2007/0216212 | A1 * | 9/2007 | Micheel | A47C 9/105 297/451.2 |

(Continued)

FOREIGN PATENT DOCUMENTS

| | | | |
|---|---|---|---|
| CA | 2434812 | A1 | 11/2003 |

*Primary Examiner* — Ryan D Kwiecinski
(74) *Attorney, Agent, or Firm* — Kyle A. Fletcher, Esq.

(57) ABSTRACT

The collapsible tripod fishing seat is adapted for use in water. The collapsible tripod fishing seat is adapted for use during wade fishing. The collapsible tripod fishing seat is adjustable in height. The collapsible tripod fishing seat is collapsible. The collapsible tripod fishing seat is designed to float in the collapsed position. The collapsible tripod fishing seat comprises a plurality of telescopic poles, a plurality of hinge mechanisms, a seat, a tether, and a mesh surface. The plurality of hinge mechanisms, the seat, the tether, and the mesh surface are attached to the plurality of telescopic poles.

16 Claims, 8 Drawing Sheets

(56) References Cited

U.S. PATENT DOCUMENTS

| | | | | |
|---|---|---|---|---|
| 2009/0174232 | A1* | 7/2009 | Hoffman | A47C 4/42 297/16.1 |
| 2009/0206226 | A1* | 8/2009 | Forrest | |
| 2010/0314914 | A1* | 12/2010 | Mazzola | A47C 3/34 297/16.2 |
| 2013/0187431 | A1* | 7/2013 | Grace | A47C 9/105 297/452.48 |
| 2015/0351548 | A1* | 12/2015 | Schiraga | A47C 4/04 297/452.1 |
| 2016/0213154 | A1* | 7/2016 | Chiasson | A47C 9/105 |
| 2017/0099955 | A1* | 4/2017 | Aydt | A47C 9/105 |

* cited by examiner

COLLAPSIBLE TRIPOD FISHING SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including chairs stools and benches, more specifically, parts, details, and accessories for a chair.

SUMMARY OF INVENTION

The collapsible tripod fishing seat is adapted for use in water. The collapsible tripod fishing seat is adapted for use during wade fishing. The collapsible tripod fishing seat is adjustable in height. The collapsible tripod fishing seat is collapsible. The collapsible tripod fishing seat is designed to float in the collapsed position.

These together with additional objects, features and advantages of the collapsible tripod fishing seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible tripod fishing seat in detail, it is to be understood that the collapsible tripod fishing seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible tripod fishing seat.

It is therefore important that the claims be regarded as including such equivalent construction insofar as they do not depart from the spirit and scope of the collapsible tripod fishing seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
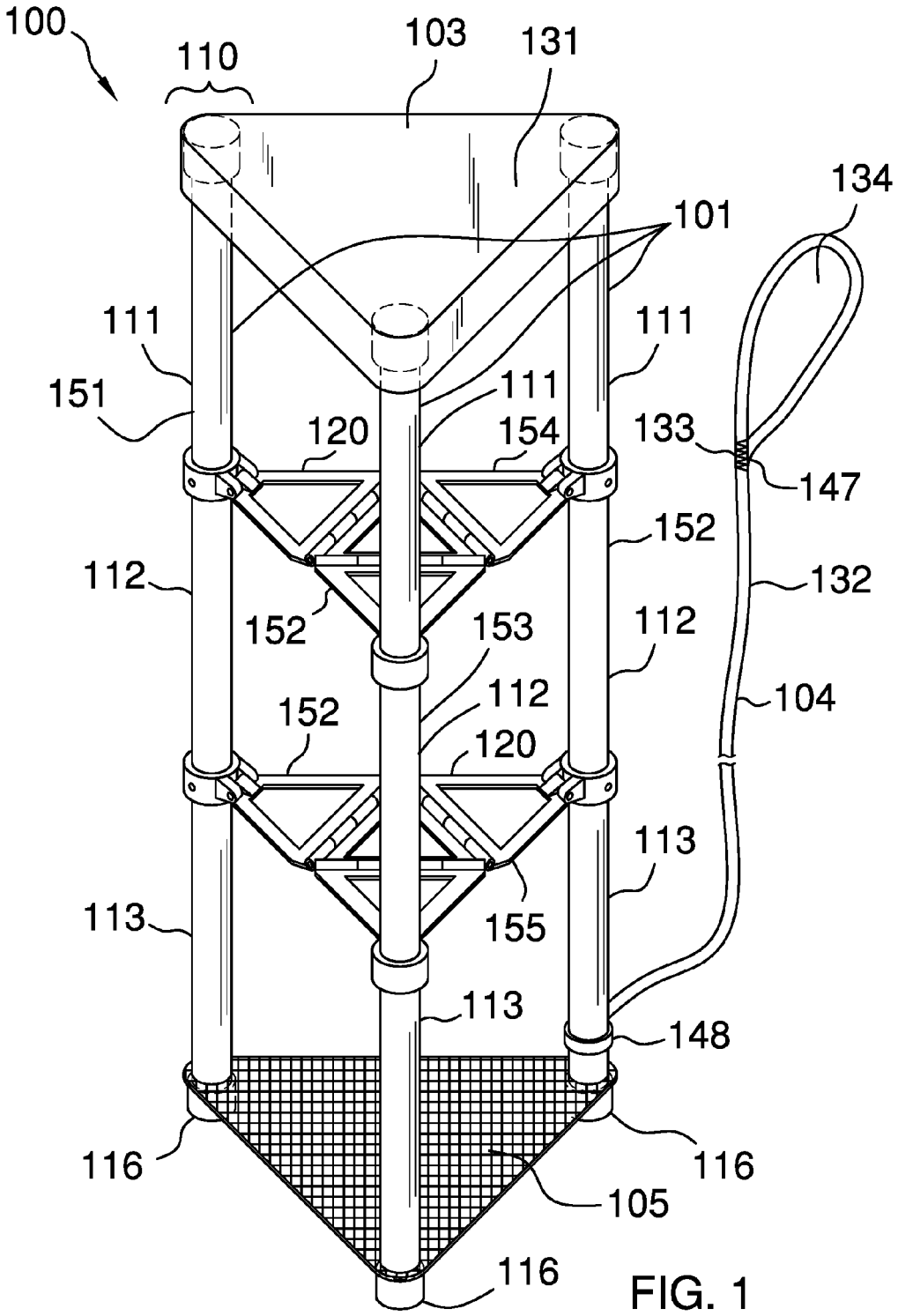
FIG. 1 is a perspective view of an embodiment of the disclosure.
Figure 2:
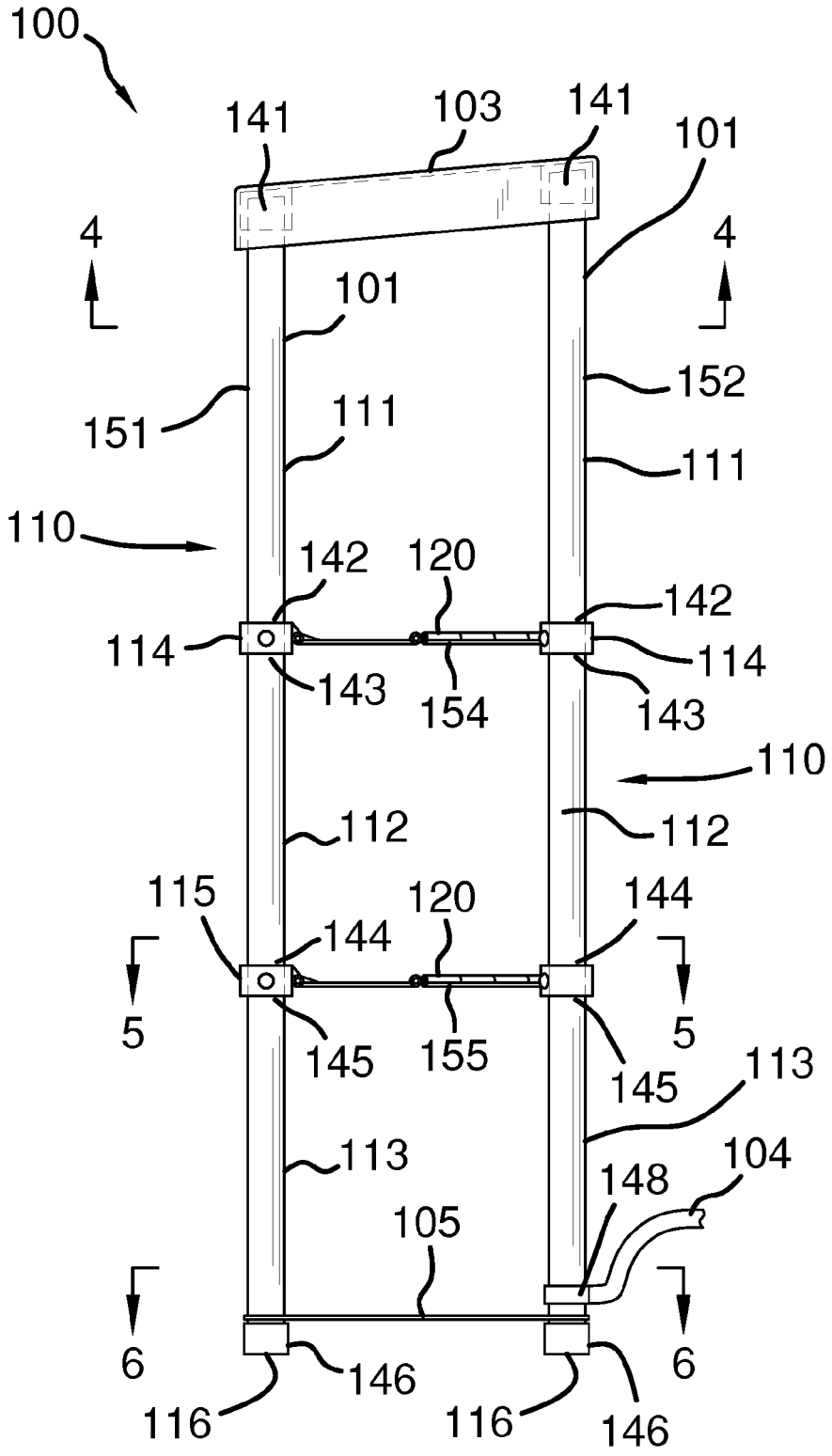
FIG. 2 is a side view of an embodiment of the disclosure.
Figure 3:
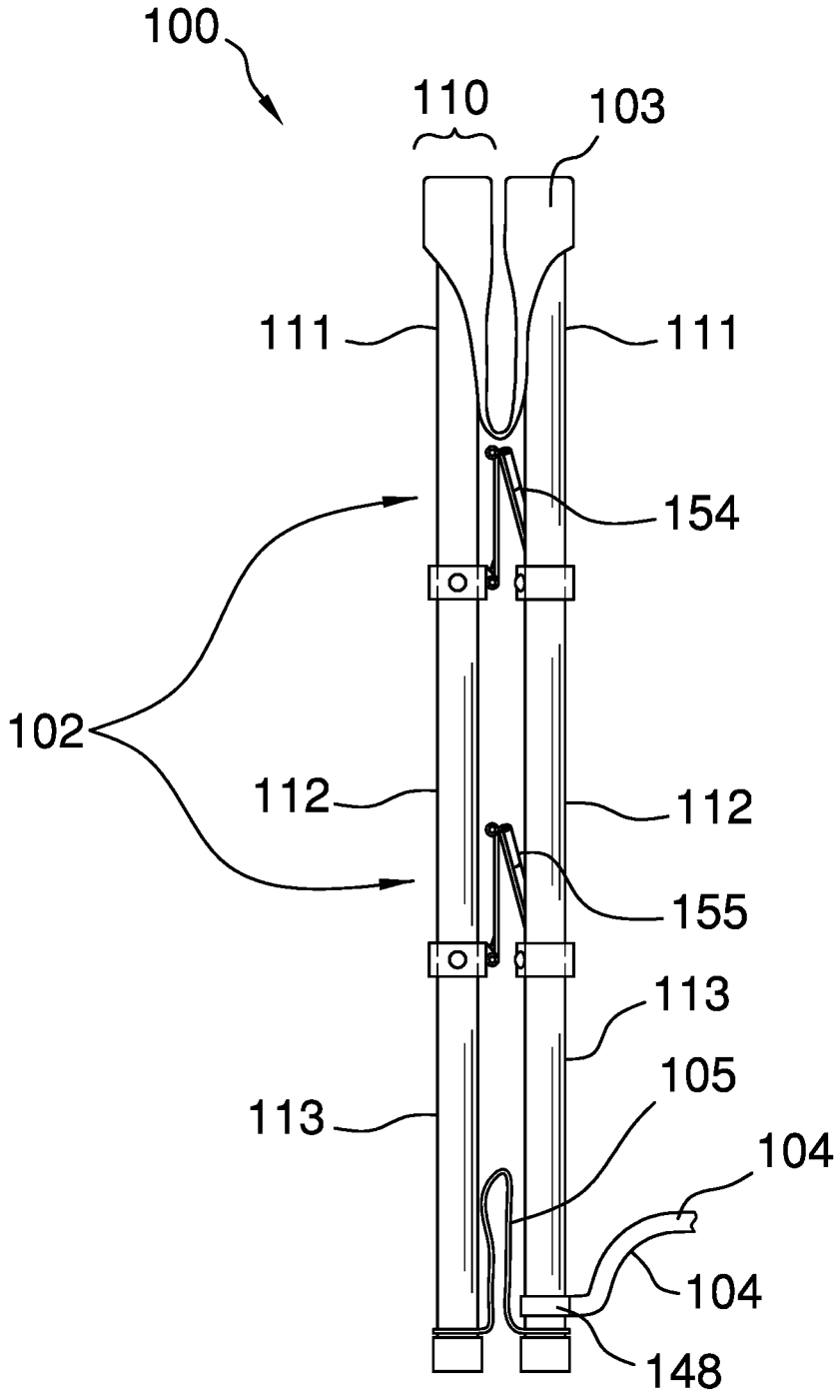
FIG. 3 is a side view of an embodiment of the disclosure.
Figure 4:
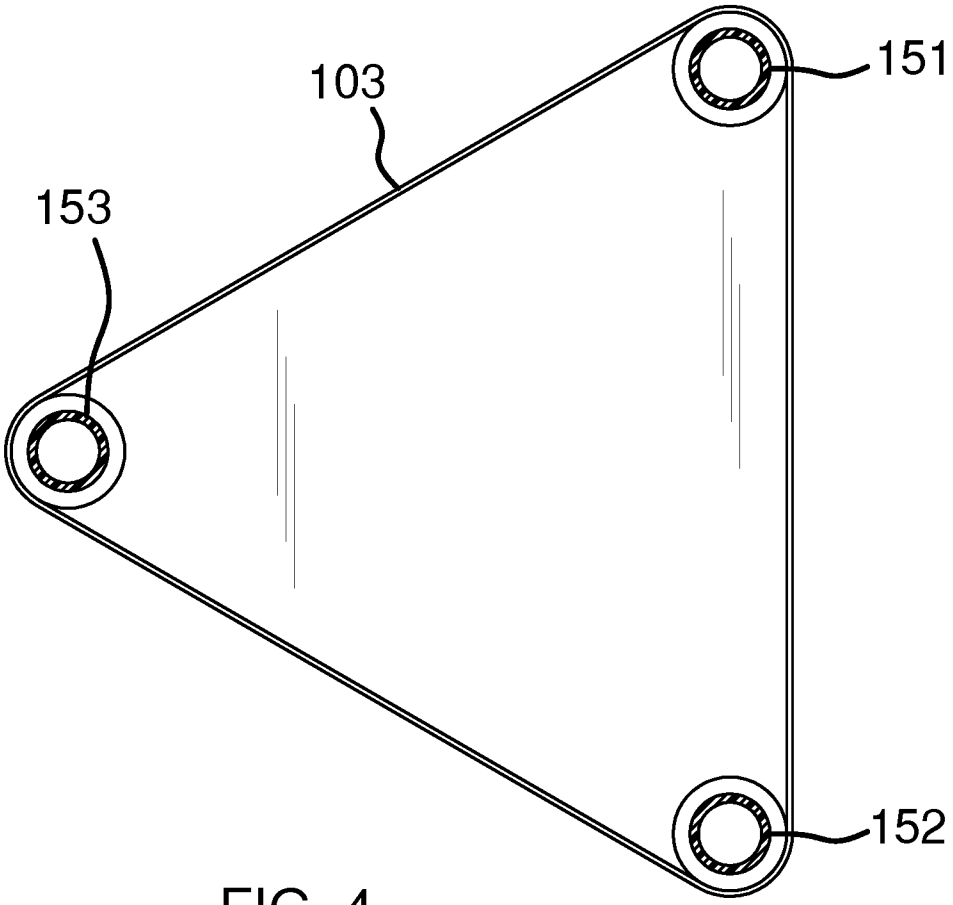
FIG. 4 is a bottom view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8F.

The collapsible tripod fishing seat 100 (hereinafter invention) comprises a plurality of telescopic poles 101, a plurality of hinge mechanisms 102, a seat 103, a tether 104, and a mesh surface 105. The plurality of hinge mechanisms 102, the seat 103, the tether 104, and the mesh surface 105 are attached to the plurality of telescopic poles 101. The invention 100 is adapted for use in water. The invention 100 is adapted for use during wade fishing. The invention 100 is adapted for use on a water bed 136. The invention 100 is adjustable in height. The invention 100 is collapsible. The invention 100 is designed to float in the collapsed position.

Each individual telescopic pole 110 comprises a first arm 111, a second arm 112, a third arm 113, a first detent 114, and a second detent 115. Each individual telescopic pole 110 further comprises an end cap 116. The first arm 111 is a hollow pipe that is further defined with a first end 141 a second end 142, a first inner dimension, and a first outer dimension. The second arm 112 is further defined with a third end 143 and a fourth end 144 a second inner dimension, and a second outer dimension. The third arm 113 is further defined with a fifth end 145 and a sixth end 146 a third inner dimension, and a third outer dimension. The end cap 116 is attached to the sixth end 146 of the third arm 113.

Each individual telescopic pole 110 is assembled as described in this paragraph. The first detent 114 connects the second arm 112 to the first arm 111. The second outer dimension of the second arm 112 is less than the first inner dimension of the first arm 111 such that the second arm 112 can be inserted into the first arm 111 in a telescopic manner. This telescopic arrangement of the individual telescopic pole 110 allows the length of the individual telescopic pole 110 to be adjusted by adjusting the relative position of the second arm 112 within the first arm 111. The position of the second arm 112 relative to the first arm 111 is held in position using the first detent 114. The first detent 114 is a mechanical device that connects and secures the first arm 111 to the second arm 112. The second detent 115 connects the third arm 113 to the second arm 112. The third outer dimension of the third arm 113 is less than the second inner dimension of the second arm 112 such that the third arm 113 can be inserted into the second arm 112 in a telescopic manner. This telescopic arrangement of the individual telescopic pole 110 allows the length of the individual telescopic pole 110 to be adjusted by adjusting the relative position of the third arm 113 within the second arm 112. The position of the third arm 113 relative to the second arm 112 is held in position using the second detent 115. The second detent 115 is a mechanical device that connects and secures the second arm 112 to the third arm 113. The first detent 114 is selected from the group consisting of a cotter pin 181, a G snap collar 182, a cam lock collar 183, a threaded clutch 184, a split collar lock 185, or a spring loaded ball lock 186. The second detent 115 is selected from the group consisting of a cotter pin 181, a G snap collar 182, a cam lock collar 183, a threaded clutch 184, a split collar lock 185, or a spring loaded ball lock 186.

Each individual hinge mechanism 120 comprises a first triangular plate 121, a second triangular plate 122, a third triangular plate 123, a fourth triangular plate 124, a first hinge 125, a second hinge 126, and a third hinge 127. The first triangular plate 121 is an equilateral triangular shaped plate structure with an open center. The first triangular plate 121 is further defined with a first edge 161, second edge 162 and a third edge 163. The second triangular plate 122 is an equilateral triangular shaped plate structure with an open center. The second triangular plate 122 is further defined with a fourth edge 164, a fifth edge 165 and a sixth edge 166. The third triangular plate 123 is an equilateral triangular shaped plate structure with an open center. The third triangular plate 123 is further defined with a seventh edge 167, an eighth edge 168 and a ninth edge 169. The fourth triangular plate 124 is an equilateral triangular shaped plate structure with an open center. The fourth triangular plate 124 is further defined with a tenth edge 170, an eleventh edge 171 and a twelfth edge 172. While there are variations between the vertices, the first triangular plate 121, the second triangular plate 122, the third triangular plate 123, and the fourth triangular plate 124 are essentially identical in size and shape.

Figure 5:
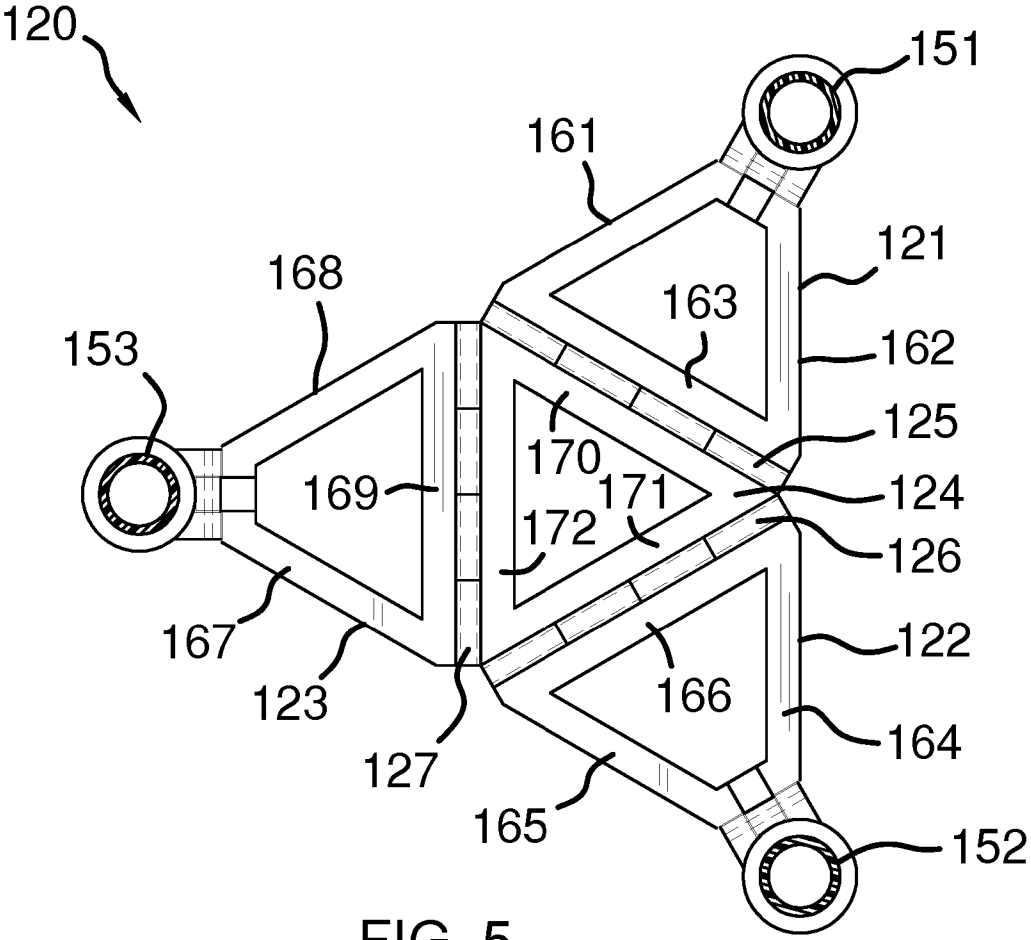
FIG. 5 is a detail view of an embodiment of the disclosure.
Figure 6:
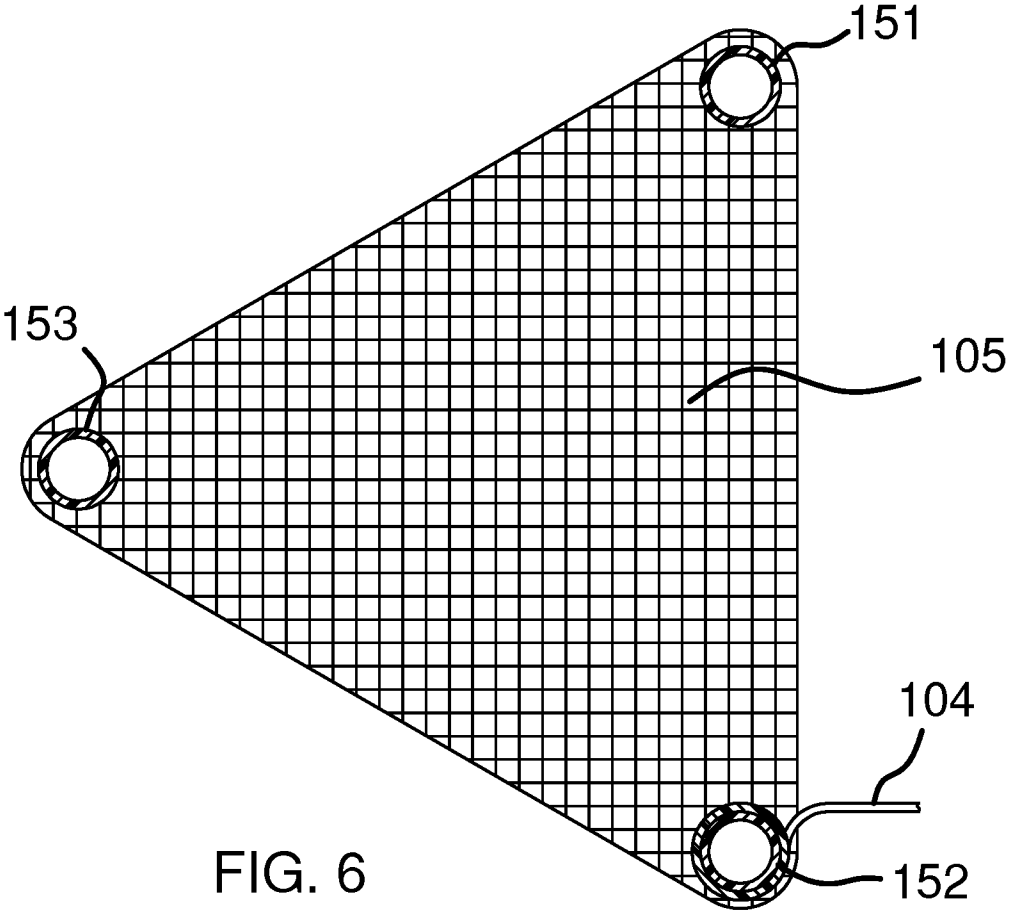
FIG. 6 is a detail view of an embodiment of the disclosure.
Figure 7:
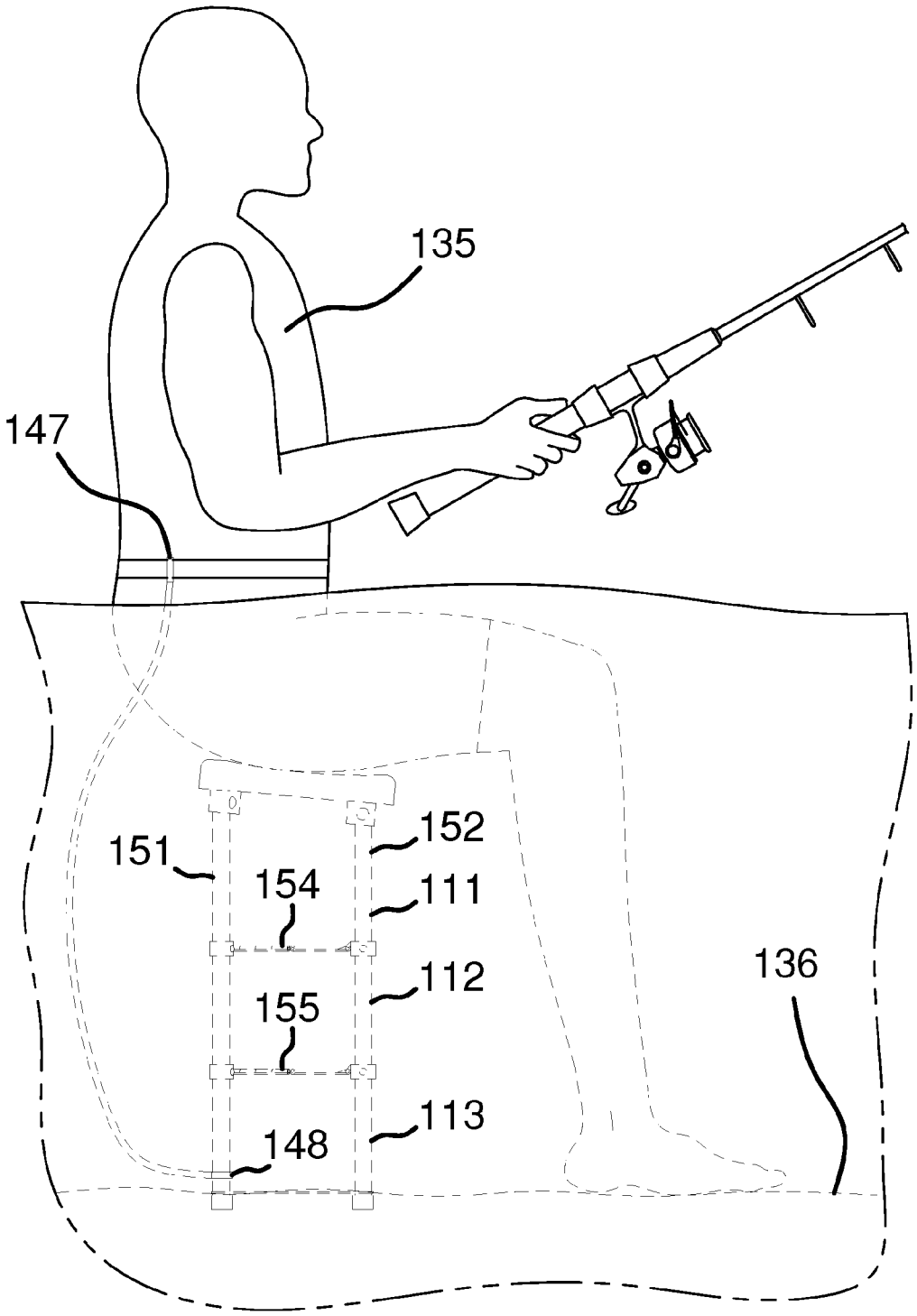
FIG. 7 is an in use view of an embodiment of the disclosure.
Figure 8A:
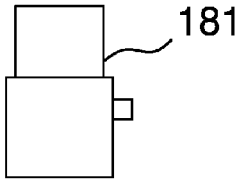
FIG. 8A involves a detail view of an embodiment of the disclosure.
Figure 8B:
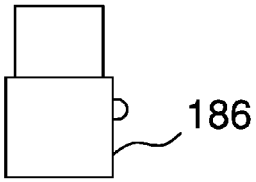
FIG. 8B involves a detail view of an embodiment of the disclosure.
Figure 8C:
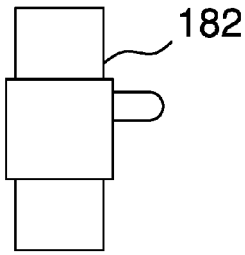
FIG. 8C involves a detail view of an embodiment of the disclosure.
Figure 8D:
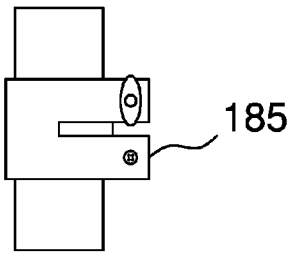
FIG. 8D involves a detail view of an embodiment of the disclosure.
Figure 8E:
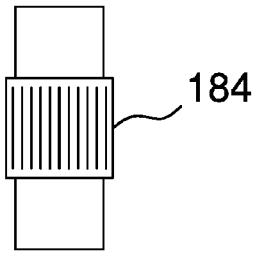
FIG. 8E involves a detail view of an embodiment of the disclosure.
Figure 8F:
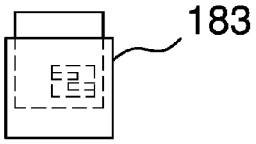
FIG. 8F involves a detail view of an embodiment of the disclosure.

As shown most clearly in FIG. 5, each individual hinge mechanism 120 is formed in the rough shape of a triangle assembled from the first triangular plate 121, the second triangular plate 122, the third triangular plate 123, the fourth triangular plate 124, the first hinge 125, the second hinge 126, and the third hinge 127. Specifically, the perimeter of the triangular shape of the individual hinge mechanism 120 is formed the first edge 161, the second edge 162, the fourth edge 164, the fifth edge 165, the seventh edge 167 and the eighth edge 168. The assembly of the individual hinge mechanism 120 requires: 1) joining the third edge 163 to the tenth edge 170 using the first hinge 125; joining the sixth edge 166 to the eleventh edge 171 using the second hinge 126; and, 3) joining the ninth edge 169 to the twelfth edge 172 using the third hinge 127. The first hinge 125, the second hinge 126 and the third hinge 127 attach to the fourth triangular plate 124 such that when the individual hinge mechanism 120 is lifted by the fourth triangular plate 124, the first triangular plate 121, the second triangular plate 122, and the third triangular plate 123 will all fold by rotating the same direction (i.e. all will fold towards or away from the seat 103).

The invention 100 is assembled as follows in this paragraph and the following 2 paragraphs. The vertex formed at the intersection first edge 161 and the second edge 162 of each hinge mechanism selected from the plurality of hinge mechanisms 102 attaches to a first telescopic pole 151 selected from the plurality of telescopic poles 101 using commercially available hardware. The vertex formed at the intersection fourth edge 164 and the fifth edge 165 of each hinge mechanism selected from the plurality of hinge mechanisms 102 attaches to a second telescopic pole 152 selected from the plurality of telescopic poles 101 using commercially available hardware. The vertex formed at the intersection seventh edge 167 and the eighth edge 168 of each hinge mechanism selected from the plurality of hinge mechanisms 102 attaches to a third telescopic pole 153 selected from the plurality of telescopic poles 101 using commercially available hardware. In the first potential embodiment of the disclosure, the plurality of hinge mechanisms 102 comprises a first hinge mechanism 154 and a second hinge mechanism 155.

The seat 103 is the supporting surface that will be sat upon. The seat 103 is supported by the first end 141 of the first telescopic pole 151, first end 141 of the second telescopic pole 152, and the first end 141 of the third telescopic pole 153. In the first potential embodiment of the disclosure, the seat 103 is a textile 131 that is suspended from the first end 141 of the first telescopic pole 151, first end 141 of the second telescopic pole 152, and the first end 141 of the third telescopic pole 153 much in the manner of a hammock. The textile 131 is treated with perflourobutanesulfonic acid for water resistance.

The tether 104 is readily and commercially available webbing 132 that is further defined with a seventh end 147 and an eighth end 148. A loop 134 is formed in the seventh end 147 of the webbing 132 such that the seventh end 147 can be anchored to an anchor point such as a person 135 or a rock. The loop 134 is formed by folding the seventh end 147 onto the body of the webbing 132 and securing the formed loop 134 with a seam 133. Suitable methods to form the seam 133 include, but are not limited to, a sewn seam 133, heat bonded seam 133, or an ultrasonic bonded seam 133. As shown most clearly in FIG. 7, the eighth end 148 of the tether 104 is attached to a telescopic pole selected from the plurality of telescopic poles 101. The eighth end 148 can be anchored to the telescopic pole selected from the plurality of telescopic poles 101 using a knot or commercially available hardware. The tether 104 is treated with perflourobutanesulfonic acid for water resistance.

The mesh surface 105 is a commercially available foraminous surface that is attached to the third arm 113 of each of the plurality of telescopic poles 101. The mesh surface 105 acts as a resistive surface that limits the ability of the third arm 113 of each of the plurality of telescopic poles 101 to sink into soft water beds 136.

To use the first potential embodiment of the disclosure, the length of the first telescopic pole 151, the second telescopic pole 152, and the third telescopic pole 153 are adjusted as described elsewhere in this disclosure. The first hinge mechanism 154 and the second hinge mechanism 155 are extended such as described elsewhere in this disclosure such that each telescopic pole selected from the plurality of telescopic poles 101 are separated from the remaining telescopic poles. This separation put tensions in the textile 131. The sixth end 146 of each of the plurality of telescopic poles 101 is placed in the water bed 136. The person 135 then sits on the invention 100 while wade fishing.

In the second potential embodiment of the disclosure, the first outer diameter of the first arm 111 of each of the plurality of telescopic poles 101 is selected such that volume of water displaced by the first arm 111 of the first telescopic pole 151, the first arm 111 of the second telescopic pole 152, and the first arm 111 of the third telescopic arm 153 is adequate to allow the invention 100 to float when the first telescopic pole 151, the second telescopic pole 152, and the third telescopic arm 153 are in a fully retracted position.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Cord: As used in this disclosure, a cord is a long, thin, and flexible piece of string, line, or rope. Cords are made from yarns, piles, or strands of material that are braided or twisted together or from a monofilament (such as fishing line). Cords have tensile strength but are too flexible to provide compressive strength and are not suitable for use in pushing objects. String, line, and rope are synonyms for cord.

Detent: As used in this disclosure, a detent is a device for positioning and holding one mechanical part in relation to another in a manner such that the device can be released by force applied to one or more of the parts.

Foraminous: As used in this disclosure, foraminous is an adjective that describes a surface, plate, or platform that is perforated with a plurality of holes.

Hinge: As used in this disclosure, a hinge is a device that permits the turning, rotating, or pivoting of a first object relative to a second object.

Inner Diameter: As used in this disclosure, the term inner diameter is used in the same way that a plumber would refer to the inner diameter of a pipe.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Outer Diameter: As used in this disclosure, the term outer diameter is used in the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural. In this disclosure, the terms inner diameter of a pipe and outer diameter are used as they would be used by those skilled in the plumbing arts.

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object.

Seam: As used in this disclosure, a seam is a joining of: 1) a first textile to a second textile; 2) a first sheeting to a second sheeting; or, 3) a first textile to a first sheeting.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Telescopic: As used in this disclosure, telescopic is an adjective that describes an object made of sections that fit or slide into each other such that the object can be made longer or shorter by adjusting the relative positions of the sections.

Tether: As used in this disclosure, a tether is a cord, line, webbing, or strap that is attached to an object to restrict its movement.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 8F include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claims:

1. A stool comprising:

a plurality of telescopic poles, a plurality of hinge mechanisms, a seat, a tether, and a mesh surface;

wherein the plurality of hinge mechanisms, the seat, the tether, and the mesh surface are attached to the plurality of telescopic poles;

wherein the stool is adapted for use in water;

wherein the stool is adapted for use during wade fishing;

wherein the stool is adapted for use on a water bed;

wherein the stool is adjustable in height;

wherein the stool is collapsible;

wherein each of the plurality of telescopic poles comprises a first arm, a second arm, a third arm, a first detent, and a second detent;

wherein the first arm is a hollow pipe that is further defined with a first end, a second end, a first inner dimension, and a first outer dimension;

wherein the second arm is further defined with a third end and a fourth end, a second inner dimension, and a second outer dimension;

wherein the third arm is further defined with a fifth end and a sixth end, a third inner dimension, and a third outer dimension;

wherein the first detent connects the second arm to the first arm;

wherein the second detent connects the third arm to the second arm;

wherein the second outer dimension of the second arm is less than the first inner dimension of the first arm such that the second arm can be inserted into the first arm in a telescopic manner;

wherein the third outer dimension of the third arm is less than the second inner dimension of the second arm such that the third arm can be inserted into the second arm in a telescopic manner;

wherein the position of the second arm relative to the first arm is held in position using the first detent;

wherein the first detent is a mechanical device;

wherein the position of the third arm relative to the second arm is held in position using the second detent;

wherein the second detent is a mechanical device;

wherein the relative position of the second arm within the first arm is adjustable;

wherein the relative position of the third arm within the second arm is adjustable;

wherein each of the plurality of hinge mechanisms comprises a first triangular plate, a second triangular plate, a third triangular plate, a fourth triangular plate, a first hinge, a second hinge, and a third hinge;

wherein the first triangular plate, the second triangular plate, the third triangular plate, the fourth triangular plate are interconnected using the first hinge, the second hinge, and the third hinge.

2. The stool according to claim 1 wherein the first triangular plate is an equilateral triangular shaped plate structure with an open center;

wherein the first triangular plate is further defined with a first edge, a second edge and a third edge;

wherein the second triangular plate is an equilateral triangular shaped plate structure with an open center;

wherein the second triangular plate is further defined with a fourth edge, a fifth edge and a sixth edge;

wherein the third triangular plate is an equilateral triangular shaped plate structure with an open center;

wherein the third triangular plate is further defined with a seventh edge, an eighth edge and a ninth edge;

wherein the fourth triangular plate is an equilateral triangular shaped plate structure with an open center;

wherein the fourth triangular plate is further defined with a tenth edge, an eleventh edge and a twelfth edge.

3. The stool according to claim 2 wherein each of the plurality of hinge mechanisms is formed having a triangular shape;

wherein the perimeter of the triangular shape of the individual hinge mechanism is formed the first edge, the second edge, the fourth edge, the fifth edge, the seventh edge and the eighth edge.

4. The stool according to claim 3 wherein the first hinge joins the third edge to the tenth edge;

wherein the second hinge joins the sixth edge to the eleventh edge;

wherein the third hinge joins the ninth edge to the twelfth edge.

5. The stool according to claim 4 wherein the first hinge, the second hinge and the third hinge attach to the fourth triangular plate such that when the individual hinge mechanism is lifted by the fourth triangular plate, the first triangular plate, the second triangular plate, and the third triangular plate will all fold by rotating the same direction.

6. The stool according to claim 5 wherein a first vertex is formed at an intersection of the first edge and the second edge of each of the plurality of hinge mechanisms; the first vertex attaches to a first telescopic pole selected from the plurality of telescopic poles.

7. The stool according to claim 6 wherein a second vertex formed at an intersection of the fourth edge and the fifth edge of each of the plurality of hinge mechanisms; the second vertex attaches to a second telescopic pole selected from the plurality of telescopic poles.

8. The stool according to claim 7 wherein a third vertex is formed at an intersection of the seventh edge and the eighth edge of each of the plurality of hinge mechanisms; the third vertex attaches to the third telescopic pole selected from the plurality of telescopic poles.

9. The stool according to claim 8 wherein the plurality of hinge mechanisms comprises a first hinge mechanism and a second hinge mechanism.

10. The stool according to claim 9 wherein the seat is a supporting surface;

wherein the seat is supported by the first end of the first telescopic pole, the first end of the second telescopic pole, and the first end of the third telescopic pole.

11. The stool according to claim 10 wherein the tether is a webbing that is further defined with a seventh end and an eighth end;

wherein a loop is formed in the seventh end of the webbing;

wherein the loop is formed by folding the seventh end onto the body of the webbing and securing the formed loop with a seam;

wherein the eighth end of the tether is attached to a telescopic pole selected from the plurality of telescopic poles.

12. The stool according to claim 11 wherein the mesh surface is a foraminous surface that is attached to the third arm of each of the plurality of telescopic poles.

13. The stool according to claim 12 wherein the first outer diameter of the first arm of each of the plurality of telescopic poles is selected such that volume of water displaced by the first arm of the first telescopic pole, the first arm of the second telescopic pole, and the first arm of the third telescopic arm is adequate to allow the stool to float when the first telescopic pole, the second telescopic pole, and the third telescopic arm are in a fully retracted position.

14. The stool according to claim 13 wherein the first detent is selected from the group consisting of a cotter pin, a g snap collar, a cam lock collar, a threaded clutch, a split collar lock, or a spring loaded ball lock;

wherein the second detent is selected from the group consisting of a cotter pin, a g snap collar, a cam lock collar, a threaded clutch, a split collar lock, or a spring loaded ball lock.

15. The stool according to claim 14 wherein the seat is a textile;

wherein the textile is treated with perflourobutanesulfonic acid;

wherein the tether is treated with perflourobutanesulfonic acid.

16. The stool according to claim 15 wherein the seam is selected from the group consisting of a sewn seam, heat bonded seam, or an ultrasonic bonded seam;

wherein each individual telescopic pole further comprises an end cap;

wherein the end cap is attached to the sixth end of the third arm.

* * * * *